United States Patent [19]

Ozawa

[11] 4,369,517

[45] Jan. 18, 1983

[54] X-RAY TUBE HOUSING ASSEMBLY WITH LIQUID COOLANT MANIFOLD

[75] Inventor: Thomas S. Ozawa, Chicago, Ill.

[73] Assignee: Litton Industrial Products, Inc., Beverly Hills, Calif.

[21] Appl. No.: 122,986

[22] Filed: Feb. 20, 1980

[51] Int. Cl.[3] ..... H01J 35/10; H01J 35/16

[52] U.S. Cl. ..... 378/130; 378/200; 313/36

[58] Field of Search ..... 313/36, 60, 44, 55; 250/523; 378/127, 130, 141, 200

[56] References Cited

U.S. PATENT DOCUMENTS

| | | | |
|---|---|---|---|
| 1,793,720 | 2/1931 | Risler | 313/36 X |
| 1,874,679 | 8/1932 | Willoughby | 313/24 X |
| 1,978,424 | 10/1934 | Gebhard . | |
| 2,011,647 | 8/1935 | Mouromtseff et al. . | |
| 2,222,549 | 11/1940 | Verhoeff | 250/523 X |
| 2,391,901 | 1/1946 | Hoffman | 313/24 X |
| 2,472,088 | 6/1949 | Boddie | 313/24 X |
| 2,791,708 | 5/1957 | Serduke | 313/36 X |
| 3,265,885 | 8/1966 | Porter | 362/218 |
| 3,546,511 | 12/1970 | Shimula | 313/60 X |
| 3,894,266 | 7/1975 | Souza | 313/36 X |
| 4,166,231 | 8/1979 | Braun | 313/60 |

*Primary Examiner*—Palmer C. Demeo

*Attorney, Agent, or Firm*—Robert A. Seldon; John M. Haurykiewicz

[57] ABSTRACT

A x-ray tube housing assembly is disclosed which includes a manifold for distributing incoming coolant within the housing in the area adjacent the hot zone of the x-ray tube. The manifold preferably comprises a generally tubular conductor circumferentially disposed about a first axis which is generally parallel to the axis of the tube housing.

7 Claims, 2 Drawing Figures

X-RAY TUBE HOUSING ASSEMBLY WITH LIQUID COOLANT MANIFOLD

This invention relates to high power, electric discharge devices such as x-ray tubes and, more specifically, to x-ray tube housing assemblies which utilize a circulatory coolant to reduce their operating temperature.

As is known in the art, x-ray tube housing assemblies consist of an outer usually metallic housing containing an x-ray insert tube. The insert tube has axially spaced cathode and anode electrodes, a target structure which emits x-rays and heat when struck by an electron beam, and a glass or metal envelope into which the electrodes and target are sealed. The anode structure contains the target, which absorbes the electrons emitted by the cathode, thus producing an x-ray beam. The x-ray beam passes through a window area in the insert tube, which consists of a controlled thickness of glass or a beryllium attachment in the window area to give very low x-ray absorption.

During the generation of x-rays a considerable amount of heat is generated and the target may reach a temperature as high as 1300° C. during certain x-ray procedures. A circulatory coolant and insulating medium such as oil or other insulating fluid, is accordingly directed through the tube housing assembly. Since the heat is generated at the anode and emitted from the anode into the coolant, the coolant is introduced at the anode end, passes around the exterior of the insert tube envelope and exits via an opening at the cathode end of the tube housing assembly. The coolant then passes through a cooling system where its temperature is reduced and it then repeats the circulatory cycle.

When large amounts of continuous heat are generated by x-ray insert tubes, as is the case with the use of high emissivity targets in such medical applications as computer aided tomography, cineradiography, angiography and others, effectively removing target heat is important. In these cases, a greater amount of heat is emitted from the back side of the target thus raising the temperature in this area and creating a so-called "hot zone". This "hot zone" temperature is much greater than that experienced from conventional targets and damage of the insulating materials commonly used in x-ray tube housing assemblies can result.

Due to this, consideration must accordingly be given to the design of good heat transfer systems. Oil, for example, deteriorates at high temperatures resulting in greatly reduced electrical insulation properties. In addition, the previously described "hot zone" induces stresses in the glass envelope of the insert tube and can cause the glass to fracture, thereby resulting in premature tube failure.

Conventionally, coolant is introduced into one end and withdrawn from the other end via respective openings in the tube housing assembly. U.S. Pat. No. 1,874,679 discloses a tube head having a plurality of concentrically disposed cylindrical vanes which define a plurality of concentric, annular, coolant-conducting channels. U.S. Pat. No. 1,978,424 discloses a tube assembly which includes a spirally wound fin co-operating with the internal housing wall to define a spiral coolant path within the housing.

The invention described herein accordingly results in a relatively low operating temperature, reduces the temperature of the coolant and insulating material in the "hot zone" and minimizes temperature gradients within the tube housing assembly. Briefly, the invention comprises a manifold which is circumferentially disposed around the insert tube and the inner wall of the housing. As will subsequently be described in greater detail, the manifold directs the incoming coolant to a plurality of circumferentially located regions of the insert tube envelope which lie within the "hot zone". Reference is accordingly made to the following Description of the Preferred Embodiment which, together with the Drawing, provides further details concerning my invention.

Figure 1:
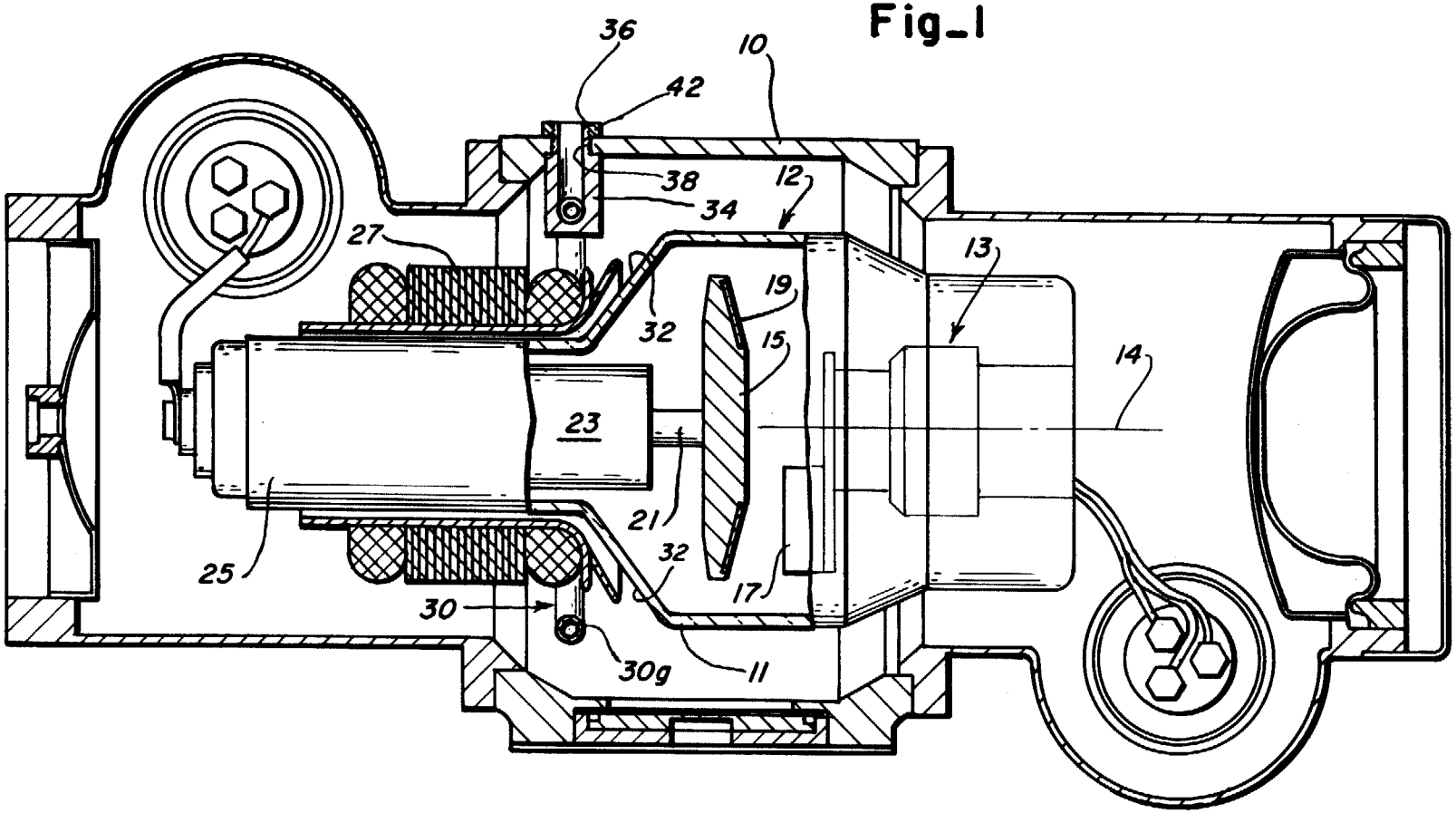
FIG. 1 is a longitudinal sectional drawing of an x-ray tube housing assembly constructed in accordance with the invention.

FIG. 1 illustrates a longitudinal section of a tube housing assembly. The tube housing assembly comprises a housing 10 which can conveniently be of any design known in the art and modified in accordance with the teachings herein. One advantage of the present invention, in fact, is the simplicity of retrofitting existing housings to improve insert tube life.

An x-ray insert tube 12 is shown within the housing 10 to comprise a glass envelope 11 disposed about a longitudinal axis 14 and enclosing a cathode 13 and a rotating anode 15 axially displaced therefrom. A tungsten filament 17 is positioned adjacent the cathode 13. The anode 15 is in the form of a disc and contains a target area 19 and is connected through a stem 21 to a hollow cylindrical rotor 23 which is mounted for rotation at 25 in the envelope 11.

In operation, the stator 27 electromagnetically induces rotation of the anode 15 while the filament 17 is heated to a temperature sufficient to cause electron emission from the cathode 13. A high voltage of, for example, 150 kVp is impressed between the cathode 13 and the anode 15 causing an electron beam to traverse the space between the cathode and anode, striking the rotating target 19 and generating x-ray energy. The electron beam typically comprises currents in the range of 5 to 1500 milliamperes. During many applications such as computer aided tomography, cine radiography and angiography, the tube may be operated for successive periods from 2 to 36 seconds, and a considerable amount of heat energy must be dissipated.

In a typical rotating anode x-ray insert tube, target temperatures of the order of 1300° C. maximum are generated, resulting in a considerable amount of heat which must be disposed of. Approximately 75-80% of this heat is radiated through the envelope 11 and the remainder convects through the stem 21 into the anode structure and other structural portions of the insert tube 12.

In order to effectively cool the insert tube 12 and maintain a non-destructive operating temperature, the illustrated housing is provided with a manifold 30 which is circumferentially disposed about the insert tube axis 14 interjacent the exterior of the insert tube 12 and the interior wall of the housing 10. As will be described below, the manifold 30 is positioned and adapted to direct incoming coolant against regions 32 of the envelope 11, hereinafter referred to as the "hot zone"of the tube, as indicated by the arrows 34. It should be immediately appreciated that improved temperature control results from the introduction of the relatively cool, incoming coolant against the hottest part of the insert tube.

Figure 2:
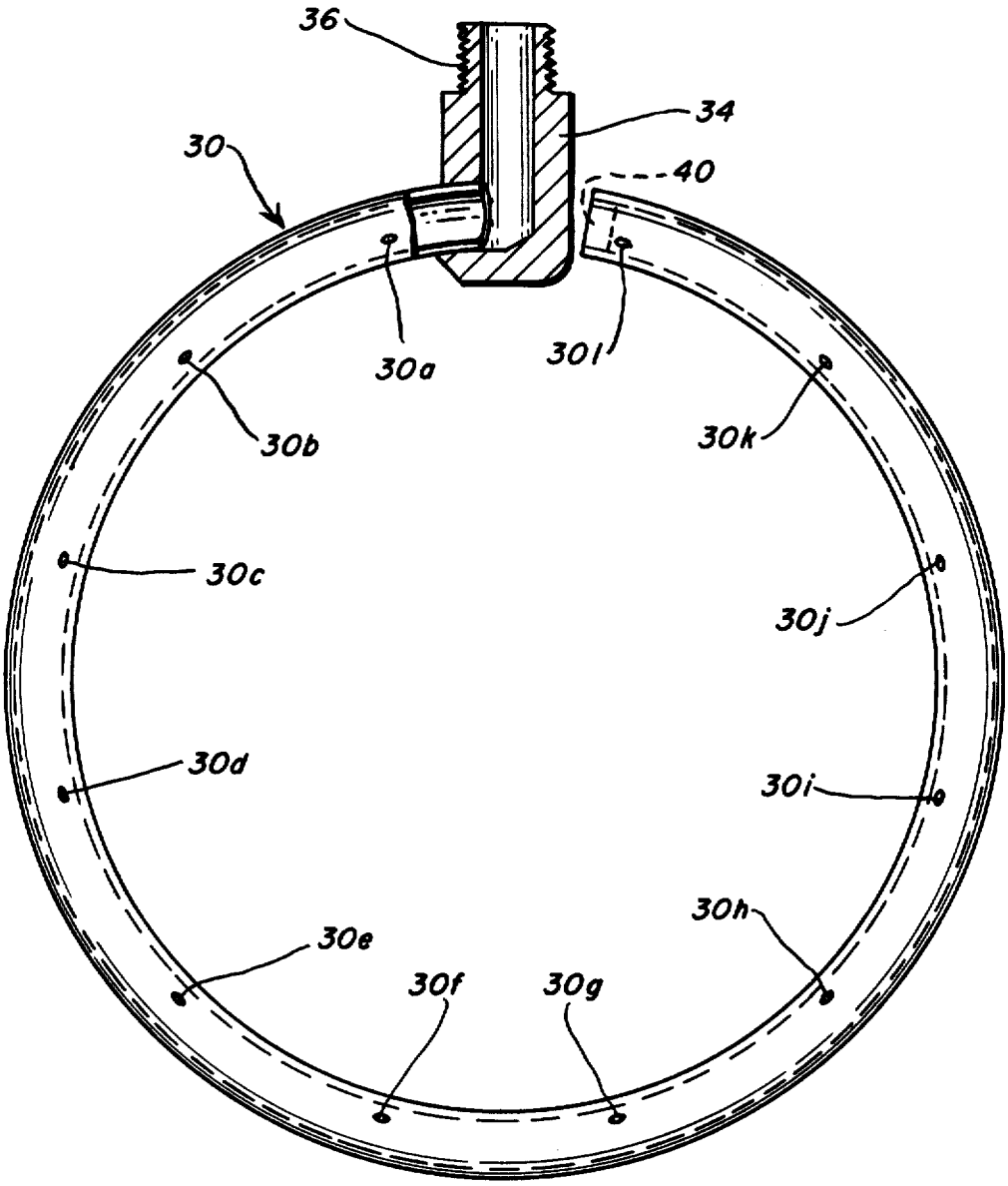
FIG. 2 shows a manifold for use with the tube housing assembly of FIG. 1 in accordance with the invention.

Reference is made to FIG. 2, which illustrates the manifold 30 of FIG. 1. The manifold 30 is shown to comprise a length of ⅜" copper tubing formed into a generally circular form of 4½ inch O.D. Twelve holes 30*a–l* are respectively drilled at approximately 30° intervals so as to direct coolant essentially uniformly along the circumference of the insert tube envelope.

The inlet end of the manifold 1 includes a fitting 34, preferably brass, which is externally threaded at 36. The externally threaded portion 36 is adapted to fit through an opening 38 in the sidewall of the housing 10, as hereinafter described. The distal end of the manifold 30 is closed by a brass plug 40. The plug 40 and fitting 34 may conveniently be soldered in place.

In the preferred embodiment, the first six holes 30*a–l* are smaller (1/16 inch diameter) than the last six holes 30*a–l* (5/64 inch) in order to obtain generally uniform fluid flow at all the holes 30*a–l*. Additionally, it has been found that a beneficial swirling of the coolant will occur and enhance the cooling of the insert tube, if the holes 30*a–f* are drilled to direct coolant towards the tube axis 14 an an angle of approximately 15°.

The particular manifold described herein, copper, was chosen because of its workability. Other metals capable of withstanding the temperatures described above may, however, also be used. Examples of such metals are brass and steel. Naturally, suitable high temperature non-metals may be employed, although none are presently known to me as retaining their structural integrity, at the elevated temperatures to which the manifold is subjected.

Returning to FIG. 1, the opening 38 in the housing 10 may be seen to accommodate the externally threaded portion 36 of the fitting 34. An internally threaded and tubular fastener 42 may then be threaded onto the protruding portion 36 of fitting 34 within to secure the manifold to the housing 10. Any sealing means such as n O-ring may be used to prevent coolant leakage through the opening 38.

Coolant is accordingly directed against the hottest part of the insert tube 12 and thereafter mixes with previously and subsequently introduced coolant, aided by the induced swirling described above. By initially contacting the region 32 of insert tube 12, the fresh coolant provides maximum cooling while it is itself heated in a manner which minimizes thermal gradients in the envelope 11 as other regions of the envelope 11 are subsequently contacted.

The coolant exits at one or, preferably, both ends of the housing to be externally cooled. In contrast to normal temperature differentials of 10° F., tube housing assemblies constructed in accordance with this invention may typically experience less than 3° F. variations between the region 32 and the ends of the housing.

While the foregoing description of the preferred embodiment is specific as to materials, shapes and dimensions, it will be apparent that variations and modifications are well within the skill of those practicing the art. Accordingly, the foregoing description is not intended to be limiting, but illustrative, and the invention is accordingly to be defined only by the claims appended hereto which, in turn, should be given the broadest scope possible and limited only by the prior art.

I claim:

1. An x-ray tube housing assembly for sealingly supporting an x-ray insert tube and a quantity of liquid coolant and wherein the insert tube has a rotating anode having an x-ray target within an envelope, the housing assembly comprising:

a housing adapted to sealingly support said x-ray insert tube and including an inlet passage and an outlet passage for respectively permitting the ingress and egress of a liquid coolant; and a manifold positioned to direct incoming coolant from said inlet passage against the insert tube in the region adjacent said target such that swirling mixing occurs with coolant present in said housing.

2. The assembly of claim 1 wherein said manifold comprises a conduit circumferentially disposed about the housing interior interjacent a wall of said housing and the insert tube and in communication with said inlet passage, the conduit including a plurality of holes arranged to direct incoming coolant against the insert tube.

3. The assembly of claim 2 wherein the holes at the remote end of the conduit are larger than the holes which are less remote from the inlet passage.

4. The assembly of claim 2 wherein the conduit is copper.

5. The assembly of claim 2 wherein the holes are arranged to direct the coolant against the insert tube at an acute angle with respect to its longitudinal axis.

6. The assembly of claim 5 wherein the acute angle is aproximately 15°.

7. A cooling manifold in combination with a rotating anode x-ray tube for use in a housing assembly, the combination comprising a rotating anode x-ray tube having a first axis and a manifold comprising a generally tubular conductor disposed about said first axis which is generally perpendicular to the axis of the tubular conductor and including a plurality of openings circumferentially disposed about said first axis and oriented radially inward at an acute angle to said first axis whereby turbulent mixing is achieved between liquid emitted from said openings and liquid already in contact with said x-ray tube.

* * * * *